United States Patent [19]

Stubbmann

[11] Patent Number: 4,610,407

[45] Date of Patent: Sep. 9, 1986

[54] FRICTIONAL DRAG ARRANGEMENT FOR SHEET MATERIAL DISPENSER

[75] Inventor: Albert Stubbmann, Franklin Lakes, N.J.

[73] Assignee: Clik-Cut, Inc., New Rochelle, N.Y.

[21] Appl. No.: 735,456

[22] Filed: May 17, 1985

[51] Int. Cl.[4] ..... B65H 16/06; B65H 23/08

[52] U.S. Cl. ..... 242/55.2; 242/75.4; 242/75.46

[58] Field of Search ..... 242/75.4, 75.45, 75.46, 242/99, 55.2, 55.53, 129.8, 156, 156.2; 225/47, 51, 82

[56] References Cited

U.S. PATENT DOCUMENTS

| | | | |
|---|---|---|---|
| 1,659,259 | 2/1928 | Grout | 242/156.2 |
| 2,073,429 | 3/1937 | Spicher | 242/55.2 |
| 2,370,821 | 3/1945 | Stott | 242/55.2 |
| 2,410,328 | 10/1946 | Agawaite, Jr. | 242/55.2 |
| 2,657,872 | 11/1953 | Lindenmeyer | 242/55.2 |
| 3,281,089 | 10/1966 | Krueger et al. | 242/55.53 X |
| 4,215,436 | 8/1980 | Ketterer | 242/75.4 X |

FOREIGN PATENT DOCUMENTS

| | | | |
|---|---|---|---|
| 666816 | 10/1929 | France | 242/75.46 |
| 769738 | 3/1957 | United Kingdom | 242/75.4 |

*Primary Examiner*—John M. Jillions

*Attorney, Agent, or Firm*—Kirschstein, Kirschstein, Ottinger & Israel

[57] ABSTRACT

A frictional drag arrangement for a sheet material dispenser tensions the withdrawn sheet material during each withdrawal, particularly when the sheet material supply is almost completely removed from its supporting roll. The arrangement includes leaf springs mounted within stub shafts that are insertable into the supporting roll. The leaf springs exert drag forces on the material.

1 Claim, 3 Drawing Figures

FRICTIONAL DRAG ARRANGEMENT FOR SHEET MATERIAL DISPENSER

BACKGROUND OF THE INVENTION

1. Field of the Invention

This invention generally relates to a sheet material dispenser of the type wherein a user, for each use, manually grasps a free leading end portion of a supply of a limp, non-self-supportable, thin, broad, sheet material such as plastic film, and withdraws a desired length of the same to be dispensed and, more particularly, to a frictional drag arrangement for tensioning the sheet material to render the same taut during each withdrawal, particularly when the sheet material supply is almost completely spent.

2. Description of the prior art

Dispensers for dispensing sheet materials such as plastic film, metal foil, waxed paper, tissue paper, paper or like wrapping stock have been well known for both domestic and commercial purposes. For commercial wrapping purposes, plastic film, for example, was generally wound about a tubular core mounted for rotation in a box that rested flatly on a supporting surface such as a work table or countertop. The plastic film was typically furnished in large-sized and large-capacity rolls having film lengths of 500 ft. and more, and film widths on the order of 12" and more. A free leading end portion of the sheet material was generally grasped by a user with one or both hands, who then manually pulled and withdrew the material in a taut state from the box, and thereupon urged the taut material against a fixed, constantly-exposed cutter strip that was conveniently provided on the box, usually along one of the outer edges or walls of the same. The cutter strip typically had a serrated cutting edge constituted of a row of generally triangularly-shaped teeth.

As described in currently pending U.S. patent application Ser. No. 633,019, filed July 20, 1984, and owned by the same assignee as the instant invention, there were many problems associated with the aforementioned prior art dispensers, as well as other types of dispensers. It was an object of the dispenser described in said patent application to overcome those prior art problems and, in the preferred embodiment of the dispenser described in said application, a roll of sheet material was coiled around a cylindrical tubular core journaled for rotation within a housing. A free leading end portion of the sheet material was grasped by a user who pulled and manually withdrew the sheet material out from the housing. A drag was exerted on the sheet material during its withdrawal to tension the same. The drag was caused, in part, by the inertia of the coiled roll, and the friction of the sheet material engaged with various portions of the dispenser. The taut film was initially guidably moved transversely past and spaced from a cutting element mounted on the support, and thereupon the taut film was moved onto the cutting element. The cutting element was protected by a guard element also mounted on the support, and said elements were moved relative to each other in response to the movement of the taut film to expose the cutting element and cut the withdrawn sheet material moved thereonto.

The dispenser described in the aforementioned patent application proved to be extremely satisfactory for its intended purpose. In order to even further improve the efficiency of the dispensing operation, it was desirable to ensure that each successively withdrawn length of sheet material was taut, even when the sheet material was almost completely spent from the roll. The magnitude of the aforementioned drag force decreased in value as more and more of the sheet material was unwound from the roll, because the weight of the coiled roll decreased with use. Thus, a fresh roll consisting of 1000 ft., 2000 ft., 3000 ft. and more, of plastic film, and having a width on the order of 12" or 18" and more, weighed several pounds and, together with other factors, exerted a considerable drag force when one withdrew the leading end portion of the material. However, toward the end of the roll, for example, when there was about 100 ft. or less of film remaining, the weight of the roll was considerably less, and the drag force contributed by the weight of the roll was proportionally lower. At the end of the roll in the dispenser described in said application, it sometimes happened that the drag force contributed by the weight of the roll was insufficient to exert a proper tension on the withdrawn film. Also, it was believed to be advantageous to compensate somewhat for the large differential in said drag force, due to the large differential in the weight of the roll between the beginning and end of each roll, and it was also deemed advantageous to maintain the overall drag force on the trailing end portion of the sheet material more uniform over successive dispensing operations of the roll.

SUMMARY OF THE INVENTION

1. Objects of the Invention

It is an object of this invention to further improve the efficiency of the dispensing operation in a dispenser, and particularly in the dispenser disclosed in said patent application.

It is another object of this invention to ensure that each withdrawn length of sheet material removed from a roll is taut, even when the sheet material is almost completely spent from the roll.

It is a further object of this invention to compensate somewhat for the large differential in drag force between the beginning and end of each roll.

It is yet another object of this invention to maintain the drag force more uniform over the entire dispensing operation.

It still another object of this invention to provide a reliable dispenser which is durable in construction, inexpensive to manufacture and safe to use.

2. Features of the Invention

In keeping with these objects, and others which will become apparent hereinafter, one feature of the invention resides, briefly stated, in a frictional drag arrangement for use in a dispenser of the type wherein a user, for each use, manually grasps a free leading end portion of a limp, non-self-supportable, thin, broad, sheet material and withdraws a desired length of the same to be dispensed. The frictional drag arrangement comprises a support, and a cylindrical tubular core extending along a longitudinal axis of symmetry. The core has a generally horizontally-extending median plane which extends through the symmetry axis. The core has at least one open axial end region which has an upper inner circumferential surface above the median plane, and a lower inner circumferential surface below the median plane. A coiled supply of sheet material is wound about the symmetry axis on the core to turn the same during each withdrawal of the sheet material.

The frictional drag arrangement further comprises bearing means stationarily mounted on the support and prevented from turning. The bearing means is freely insertable into the one end region of the core and slidably supports the upper inner circumferential surface of the inserted and sheet-material-laden core for turning movement of the latter about the symmetry axis during each withdrawal of the sheet material. The upper inner circumferential surface slidably and frictionally engages the stationary bearing means, and exerts a first drag force on each trailing end portion of the withdrawn sheet material to tauten the same. The first drag force has a magnitude which decreases in value as more of the sheet material is spent and removed from the core. The lower inner circumferential surface is spaced at a clearance from the stationary bearing means.

In further accordance with this invention, drag means are provided for spanning the clearance between the stationary bearing means and the lower inner circumferential surface of the core. The drag means is operative for constantly urging the bearing means into engagement with the upper inner circumferential surface of the core to enhance the first drag force. The drag means is also operative for constantly engaging the lower inner circumferential surface of the core for exerting a second drag force on each successive trailing end portion of the withdrawn sheet material to tauten the same. This second drag force has a magnitude sufficient to tauten each successively withdrawn sheet material, even when the first drag force has decreased, due to removal of the sheet material from the core, to a value less than the minimum required to properly tension the withdrawn sheet material. Hence, in accordance with this latter feature, each withdrawn sheet material is removed from the core in a taut condition, even when the sheet material is almost completely removed from the core. This feature ensures that a drag force above a certain minimum value is present from the beginning to the end of the roll, and compensates, at least in part, for the large differential in the drag force contributed by the weight of the sheet-material-laden core between the beginning and end of each roll, and maintains the resultant drag force more uniform over successive dispensing operations.

In a preferred embodiment, the core has a pair of open axial end regions, and the bearing means includes a pair of stub shafts, each insertable with clearance into a respective open end region of the core. In this construction, it is advantageous when the drag means constitutes a spring, preferably a leaf spring, which is mounted on each stub shaft and extends across a respective clearance to resiliently press against the lower inner circumferential surface of the respective core end regions.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
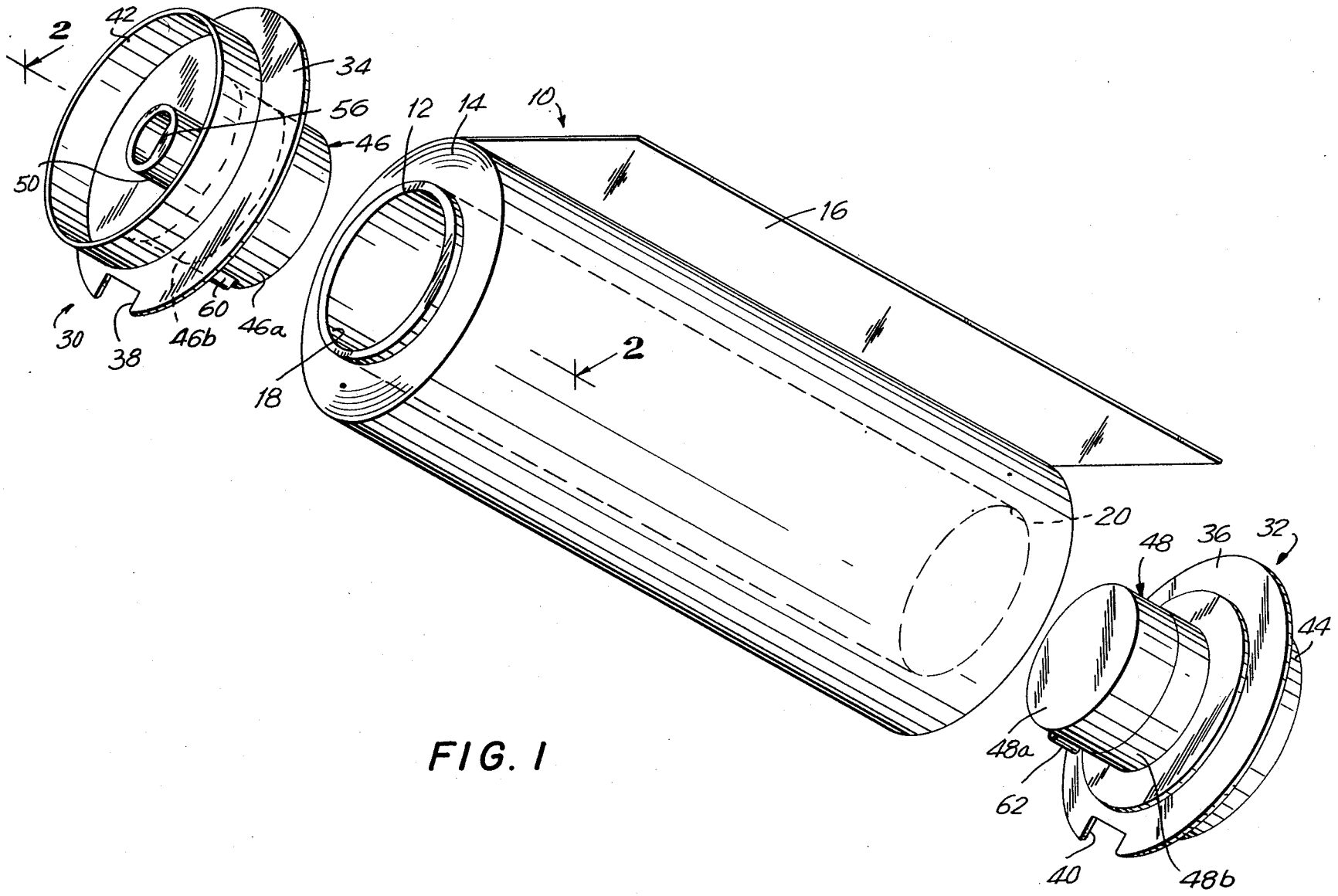
FIG. 1 is an exploded perspective view of a frictional drag arrangement for use in a dispenser in accordance with this invention.

Referring now to the drawings, reference numeral 10 generally identifies a supply roll of sheet material comprised of a cylindrical tubular core 12 preferably made of a heavy-duty paper or cardboard product, and a coiled supply of a limp, non-self-supportable, thin, broad, web or sheet material 14. The sheet material 14 may be any clinging or non-clinging plastic film such as a copolymer of vinylidine chloride and vinyl chloride (of the Saran variety), a metallic foil such as aluminum foil, waxed paper, tissue paper, paper or analogous wrapping stock. The aforementioned sheet material is typically on the order of from ½ to about 2 mils thick, although different thicknesses may be employed. The aforementioned sheet material is typically on the order of 12", 15" or 18" in width, although both smaller and larger widths are also within the scope of this invention. Such sheet material is semi-fragile in that it can be easily pierced and cut by a rigid or semi-rigid cutting edge which can be constituted of metal, plastic or an analogous hard edge, by manually urging the sheet material against the cutting edge. The length of the sheet material may be any length, although, in a preferred construction, the lengths are 1000 ft. and more. The sheet material has a free leading end region 16 adapted to be grasped by both hands of a user, and pulled off the core 12.

The roll 10 is mounted in a support or housing and, in the preferred embodiment of this invention, within the dispenser described and illustrated in co-pending U.S. patent application Ser. No. 633,019, filed July 20, 1984, and owned by the same assignee as the instant invention. For the sake of simplifying the description, the entire contents of said patent application are hereby incorporated by reference and made a part of the instant application.

Figure 3:
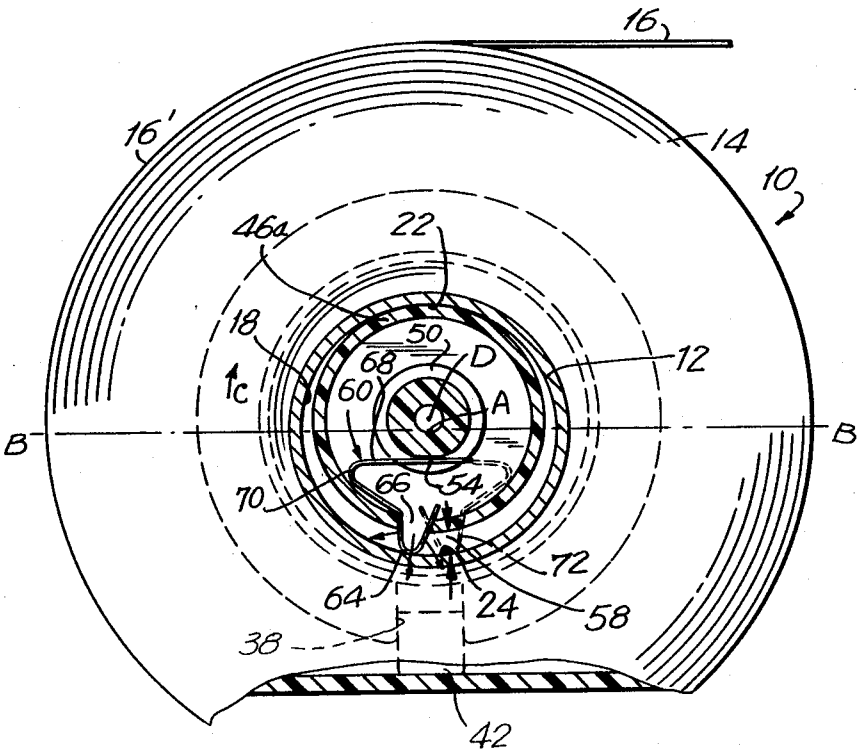
FIG. 3 is a partially broken-away sectional view taken on line 3—3 of FIG. 2.
Figure 2:
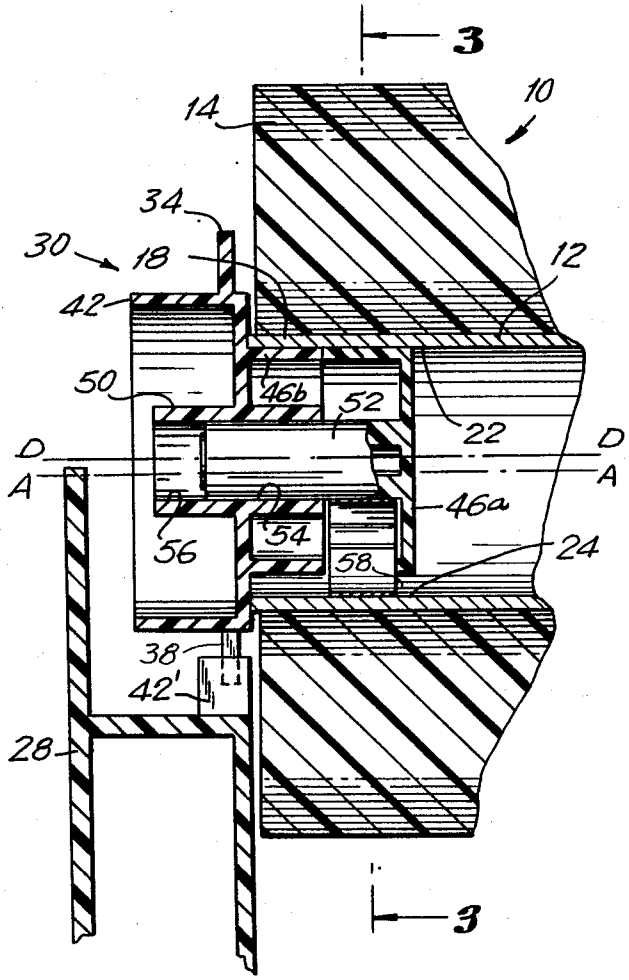
FIG. 2 is a partially broken-away sectional view taken on line 2—2 of FIG. 1 in assembled condition.

The core 12 extends along a longitudinal axis of symmetry A—A (see FIG. 2), and has a generally horizontally-extending median plane B—B (see FIG. 3) extending through the symmetry axis. The core 12 has at least one, and preferably a pair of, open end regions 18, 20 at opposite ends of the core 12. As shown in FIGS. 2 and 3, representative axial end region 18 has an upper inner circumferential surface 22 located above the median plane, and a lower inner circumferential surface 24 located below the median plane. The upper and lower inner circumferential surfaces together define a continuous circular surface which is symmetrical about axis A—A.

The coiled supply of the sheet material is tightly wound about the core 12 in a circumferential direction about the symmetry axis. In a preferred embodiment, the core 12 is slightly longer than the width of the coiled supply of sheet material 14, so that each end region 18, 20 of the core extends slightly axially outwardly of the coiled supply. As described above, for each use, a user manually grasps the free leading end region 16 of the sheet material and withdraws a desired length of the same. During each such withdrawal, the entire roll 10 turns about bearing means 30, 32 about the symmetry axis.

The bearing means 30, 32 are stationarily mounted on a support or housing 28, and are operative for slidably supporting the roll during its turning movement. The bearing means include circular flanges 34, 36 having respective radially-extending cutouts 38, 40 formed at a lower region of the flanges. The housing 28 has, for each bearing means, an upright locking projection, for example, see projection 42' in FIG. 2. Representative projection 42' in the mounted condition of the roll is snugly received in cutout 38, and is operative for preventing the bearing means from turning in a circumferential direction when the user pulls the free leading end region 16 of the sheet material from the roll 10. This pulling action causes the core 12 to rotate in the circumferential direction of the curved arrow C.

The bearing means 30, 32 also have outer axially-extending right cylindrical tubular portions 42, 44, and inner axially-extending right cylindrical stub shaft portions 46, 48. Centrally located and axially extending within each bearing means is a tubular sleeve, for example, see representative sleeve 50 in FIG. 2, which extends along a central axis D—D. A pin 52 is snugly received within sleeve 50. The pin 52, at its inner end, is integrally connected with a first stub shaft section **46*a* which, together with a second stub shaft section 46*b*, constitute the stub shaft portion 46. The pin 52 has a right cylindrical configuration except for a flat 54 which, when inserted into the sleeve 50, mates with a corresponding flat 56 formed within the sleeve 50. The pin 52 is thus keyed to the sleeve 50 and, as a result, the stub shaft section 46*a* is prevented from rotating about the central axis D—D. The internal construction as described in connection with stub shaft sections 46*a*, 46*b* is the same for stub shaft sections 48*a*, 48*b* of the stub shaft portion 48**.

The stub shaft portions 46, 48 are freely insertable into axial end regions 18, 20, respectively, of the core, and slidably support the upper inner circumferential surfaces 22 of the inserted roll for turning movement of the latter about the symmetry axis A—A during each withdrawal of the sheet material. Each upper inner circumferential surface 22 slidably and frictionally engages the stub shaft portions 46, 48 at an upper outer surface of the same, and exerts a first drag force on each trailing end portion, for example, portion 16' in FIG. 3, of the sheet material to tauten the withdrawn sheet material. This first drag force has a magnitude which decreases in value as more of the material is spent from the roll, because this first drag force is proportionally related to the weight of the roll. Thus, as more and more sheet material is removed from the roll, the roll weighs less and this first drag force will be less.

Each outer diameter of stub shaft portions 46, 48 is less than each inner diameter of the axial end regions 18, 20. Hence, as shown in FIG. 3, each lower inner circumferential surface 24 is spaced at a clearance 58 from a lower surface of the stub shaft portions 46, 48. As also shown in FIG. 3, the central axis D—D is located at a higher elevation than the symmetry axis A—A. The aforementioned clearance 58 is, in a preferred embodiment, slight, and is on the order of 0.073". Spanning each clearance 58 are drag means 60, 62 which are located between the stationary stub shaft portions 46, 48 and the respective lower inner circumferential surfaces 24 of the core 12. Each drag means is preferably constituted by a spring and, more particularly, a leaf spring, each spring being operative for constantly urging the stub shaft portions 46, 48 into engagement with the upper inner circumferential surface 22 of the core 12 to enhance and increase the aforementioned first drag force. In addition, each spring is mounted on the stub shaft portions 46, 48 and engages the respective lower inner circumferential surface 24 of the core 12 for exerting a second drag force on each trailing end portion 16' of the withdrawn sheet material to tauten the same. This second drag force has a magnitude sufficient to tauten each withdrawn sheet material, even when the first drag force has decreased, due to removal of the sheet material 14 from the core, to a value insufficient for tautening the withdrawn sheet material. Thus, each successively withdrawn sheet material is removed from the core in a taut condition, even when the sheet material is almost completely removed from the core, and even when the roll is almost completely spent.

As best shown in FIG. 3, representative drag means 60 has a nose portion 64 protruding radially outwardly through an aperture 66 formed in stub shaft section **46*a*, and beyond the same into engagement with the lower inner circumferential surface 24 of the core, a generally planar support portion 68 resiliently bearing against the outer circumferential surface of the pin 52, and an intermediate spring portion 70 located between the nose portion 64 and the support portion 68. When the spring 60 is mounted, as shown in FIG. 3, then the support portion 68 resiliently presses against the pin 52 and, in turn, presses the uppermost surface of the stub shaft section 46*a* into frictional engagement with the upper inner circumferential surface 22. At the same time, the nose portion 64 resiliently presses against the lower inner circumferential surface 24**.

As for the other drag means 62, it has the identical spring mounted within its stub shaft section **48*a* and, for the sake of brevity, the description thereof will not be repeated, except to point out that, in a variant of this invention, nose portion 72 (shown in dotted lines in FIG. 3) of the drag means 62 extends outwardly of its respective stub shaft section 48*a* at a different angle of inclination relative to the vertical. Thus, the nose portion 64 is angled at approximately 20° relative to the left of the vertical, and the nose portion 72 is located 20° to the right of the vertical. With this configuration, nose portion 64** additionally acts as a brake to prevent the roll from continuing to turn about the rotation axis due to inertia after the user has stopped withdrawing the sheet material from the roll.

The operation of the frictional drag arrangement is believed to be self-evident from the description given above, but, for the sake of completeness, it will now be briefly summarized.

Thus, each time a user wishes to dispense sheet material, he or she manually grasps the free leading end portion 16 of the sheet material and withdraws a desired length of the same. During each such withdrawal, the roll 10 turns about the stationary stub shafts 46, 48. At the beginning of each roll, the first drag force, whose magnitude, at least in part, depends upon the weight of the roll, is sufficient to tauten each successively withdrawn sheet material. By the time the roll is largely spent, the magnitude of this first drag force is much less than at the beginning of the roll and, in some circumstances, may be insufficient to properly tauten the withdrawn sheet material. Hence, the second drag force exerted by the springs comes more and more into play to ensure that each withdrawn sheet material is properly tensioned. Thus, over successive dispensing operations, the overall drag force on the sheet material at the beginning and at the end of the roll is sufficient to tension the withdrawn sheet material.

In a currently preferred mechanical construction, the outer diameter of each stub shaft is approximately 1.490", the inner diameter of the core 12 ranges from about 1.490" to about 1.571", and the nose portions 64, 72 of the drag means 60, 62 extend outwardly from their respective stub shaft sections to a distance sufficient to define an outer diameter of about 1.600". Each spring exerts a force of about 700 grams per square inch on the lower inner circumferential surface 24.

In addition, the bearing means are preferably constituted of a synthetic ABS plastic material, the core 12 is preferably constituted of a heavy-duty paper or cardboard-like material, and the spring is preferably made of spring steel.

It will be understood that each of the elements described above, or two or more together, also may find a useful application in other types of constructions differing from the types described above.

While the invention has been illustrated and described as embodied in a frictional drag arrangement for sheet material dispensers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a sheet material plastic film dispenser of the type wherein a user, for each use, manually grasps transversely spaced-apart regions of a free leading end portion of a limp, non-self-supportable, thin, broad sheet film material having a transverse width at least equal to ten inches, and withdraws a desired length of the film material to be dispensed under tension to an elevated position above a planar cutting blade, and thereupon lowers the tensioned withdrawn film material onto the cutting blade in a plane generally perpendicular to that of the cutting blade to effect cutting of the lowered film material across its entire transverse width, a frictional drag arrangement comprising:

(a) a support;

(b) a cylindrical tubular core extending along a longitudinal axis of symmetry and having a generally horizontally-extending median plane extending through the symmetry axis, said core having a pair of open axial end regions, each having an upper inner circumferential surface above the median plane and a lower inner circumferential surface below the median plane;

(c) a coiled supply of the sheet film material wound about the symmetry axis on the core to turn the same during each withdrawal of the tensioned sheet film material;

(d) bearing means stationarily mounted on the support and having a pair of discrete stub shafts, each having an interior horizontally-extending pin and a circumferential wall surrounding the pin and bounding an interior space therewith, each circumferential wall having an aperture, each stub shaft being freely insertable into a respective end region of the core and slidably supporting the upper inner circumferential surface of the inserted and sheet-material-laden core for turning movement of the latter about the symmetry axis during each withdrawal of the sheet material, said upper inner circumferential surfaces slidably and frictionally engaging the stationary stub shafts and exerting a first drag force on each trailing end portion of the withdrawn sheet film material to tauten the same, said first drag force having a magnitude which decreases in value as more of the sheet film material is spent and removed from the core, said lower inner circumferential surfaces being spaced at a clearance from the stationary stub shafts; and (e) drag means spanning the clearance between the stationary stub shafts and the lower inner circumferential surfaces of the core, and operative for constantly urging the stub shafts into engagement with the upper inner circumferential surfaces of the core to enhance the first drag force, and also engaging the lower inner circumferential surfaces of the core for exerting a second drag force on each trailing end portion of the withdrawn sheet film material to tauten the same, said second drag force having a magnitude sufficient to ensure tautening of each successively withdrawn sheet material even when the sheet film material is almost completely removed from the core, said drag means constituting a folded leaf spring mounted within each interior space of a respective stub shaft, each leaf spring having one end bearing against a respective pin, and an opposite free end extending through a respective aperture and bearing against the lower inner circumferential surfaces of the core.

* * * * *